US009066606B1

(12) United States Patent
Archer-Hall

(10) Patent No.: US 9,066,606 B1
(45) Date of Patent: Jun. 30, 2015

(54) COLLAPSIBLE HIGH CHAIR WITH LOCKING LEGS

(71) Applicant: Carol Archer-Hall, Detroit, MI (US)

(72) Inventor: Carol Archer-Hall, Detroit, MI (US)

( * ) Notice: Subject to any disclaimer, the term of this patent is extended or adjusted under 35 U.S.C. 154(b) by 0 days.

(21) Appl. No.: 14/263,521

(22) Filed: Apr. 28, 2014

(51) Int. Cl.

| | |
|---|---|
| ***A47C 4/00*** | (2006.01) |
| ***A47D 1/02*** | (2006.01) |
| ***A47C 4/28*** | (2006.01) |
| ***A47D 1/00*** | (2006.01) |
| ***A47C 4/30*** | (2006.01) |
| ***A47C 4/34*** | (2006.01) |
| ***A47C 4/38*** | (2006.01) |

(52) U.S. Cl.
CPC ... *A47D 1/02* (2013.01); *A47C 4/28* (2013.01); *A47D 1/008* (2013.01); *A47C 4/286* (2013.01); *A47C 4/30* (2013.01); *A47C 4/34* (2013.01); *A47C 4/38* (2013.01)

(58) Field of Classification Search
CPC ..... A47D 1/02; A47D 1/008; A47D 15/006; A47C 4/28; A47C 4/286; A47C 4/30; A47C 4/34; A47C 4/38; A47C 4/52; A47C 7/68
See application file for complete search history.

(56) References Cited

U.S. PATENT DOCUMENTS

| | | | | |
|---|---|---|---|---|
| 2,687,167 | A * | 8/1954 | Janesick | 297/151 |
| 2,699,817 | A | 1/1955 | Adler et al. | |
| 3,012,815 | A | 12/1961 | Smith | |
| 3,136,272 | A * | 6/1964 | Sprigman | 108/118 |
| 4,962,965 | A * | 10/1990 | Glover | 297/467 |
| 5,131,715 | A * | 7/1992 | Balles | 297/5 |
| 5,816,662 | A * | 10/1998 | Rumburg | 297/484 |
| 6,247,750 | B1 * | 6/2001 | Tsai | 297/16.2 |
| 7,281,759 | B1 * | 10/2007 | Strong et al. | 297/45 |
| 7,600,810 | B2 | 10/2009 | Chen et al. | |
| 2006/0163922 | A1 * | 7/2006 | Flannery | 297/250.1 |
| 2008/0036256 | A1 * | 2/2008 | Gold et al. | 297/255 |
| 2009/0224577 | A1 * | 9/2009 | Chen | 297/153 |
| 2010/0072790 | A1 * | 3/2010 | Pleiman et al. | 297/45 |
| 2010/0096890 | A1 * | 4/2010 | Whitlock | 297/16.2 |
| 2011/0254327 | A1 * | 10/2011 | Halsey | 297/188.15 |
| 2013/0180936 | A1 * | 7/2013 | Subbaraman et al. | 211/45 |
| 2014/0312659 | A1 * | 10/2014 | Moon | 297/16.2 |

* cited by examiner

*Primary Examiner* — Joshua J Michener
*Assistant Examiner* — Matthew Gitlin
(74) *Attorney, Agent, or Firm* — Crossley Patent Law

(57) ABSTRACT

A collapsible high chair with locking legs including a collapsible frame, a flexible seat, a tray, and a storage bag. The chair in an extended position is intended to be used for a child while eating. The chair collapses to fit within the storage bag for transportation and storage. The collapsible frame includes four locking mechanisms to lock the legs in place in the extended position. A restraint harness, including a shoulder restraint portion and a leg restraint portion, has a buckle to restrain the child and prevent falls. The tray removably connects by a hook and loop fastener strap on both sides to the frame to provide an eating surface. The tray includes a cup holder. The tray folds in half when removed from the frame for storage.

4 Claims, 6 Drawing Sheets

COLLAPSIBLE HIGH CHAIR WITH LOCKING LEGS

BACKGROUND OF THE INVENTION

Various types of collapsible or folding high chairs are known in the prior art. However, what is needed is a collapsible high chair with locking legs including collapsible frame, a flexible seat, a tray and a storage bag. The chair in an extended position is intended to be used for a child while eating. The chair collapses to fit within the storage bag for transportation and storage. The collapsible frame includes four locking mechanisms to lock the frame in place in the extended form. A restraint harness including a shoulder restraint and a leg restraint is configured with a buckle to restrain the child and prevent falls. The tray removably connects by a fastener strap on both sides to the frame to provide an eating surface. The tray includes a cup holder. The tray folds in half when removed from the frame for storage.

FIELD OF THE INVENTION

The present invention relates to collapsible or folding high chairs, and more particularly, to a collapsible high chair with locking legs which includes a collapsible frame, a flexible seat, a restraint harness, a tray that is removable and foldable, and a storage bag. In an extended position, the collapsible high chair with locking legs forms high chair for children while eating. When placed in the extended position, the legs lock at four points on the frame providing stability. A restraint harness attached to the flexible seat includes a shoulder harness which removably connects to a leg harness by a buckle to restrain the child and prevent falls. The tray may be used as an eating surface and may be folded for storage. The tray includes two fastener straps to secure the tray to the frame. The tray includes a cup holder. The whole chair collapses to fit inside the storage bag for transportation and storage.

SUMMARY OF THE INVENTION

The general purpose of the present collapsible high chair with locking legs, described subsequently in greater detail, is to provide a collapsible high chair with locking legs which has many novel features that result in a collapsible high chair with locking legs which is not anticipated, rendered obvious, suggested, or even implied by prior art, either alone or in combination thereof.

To accomplish this, the present collapsible high chair with locking legs includes a collapsible frame, a flexible seat, a restraint harness, a tray that is removable and foldable, and a storage bag. In an extended position, the collapsible high chair with locking legs forms high chair for children while eating. When placed in the extended position, the legs lock at four points on the frame providing stability. A restraint harness attached to the flexible seat includes a shoulder harness which removably connects to a leg harness by a buckle to restrain the child and prevent falls. The tray may be used as an eating surface and may be folded for storage. The tray includes two hook and loop fastener straps to secure the tray to the frame. The tray includes a cup holder. The whole chair collapses to fit inside the storage bag for transportation and storage. The tray is formed of a non-porous material, such as metal, for easy cleaning and hygiene.

Thus has been broadly outlined the more important features of the present collapsible high chair with locking legs so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
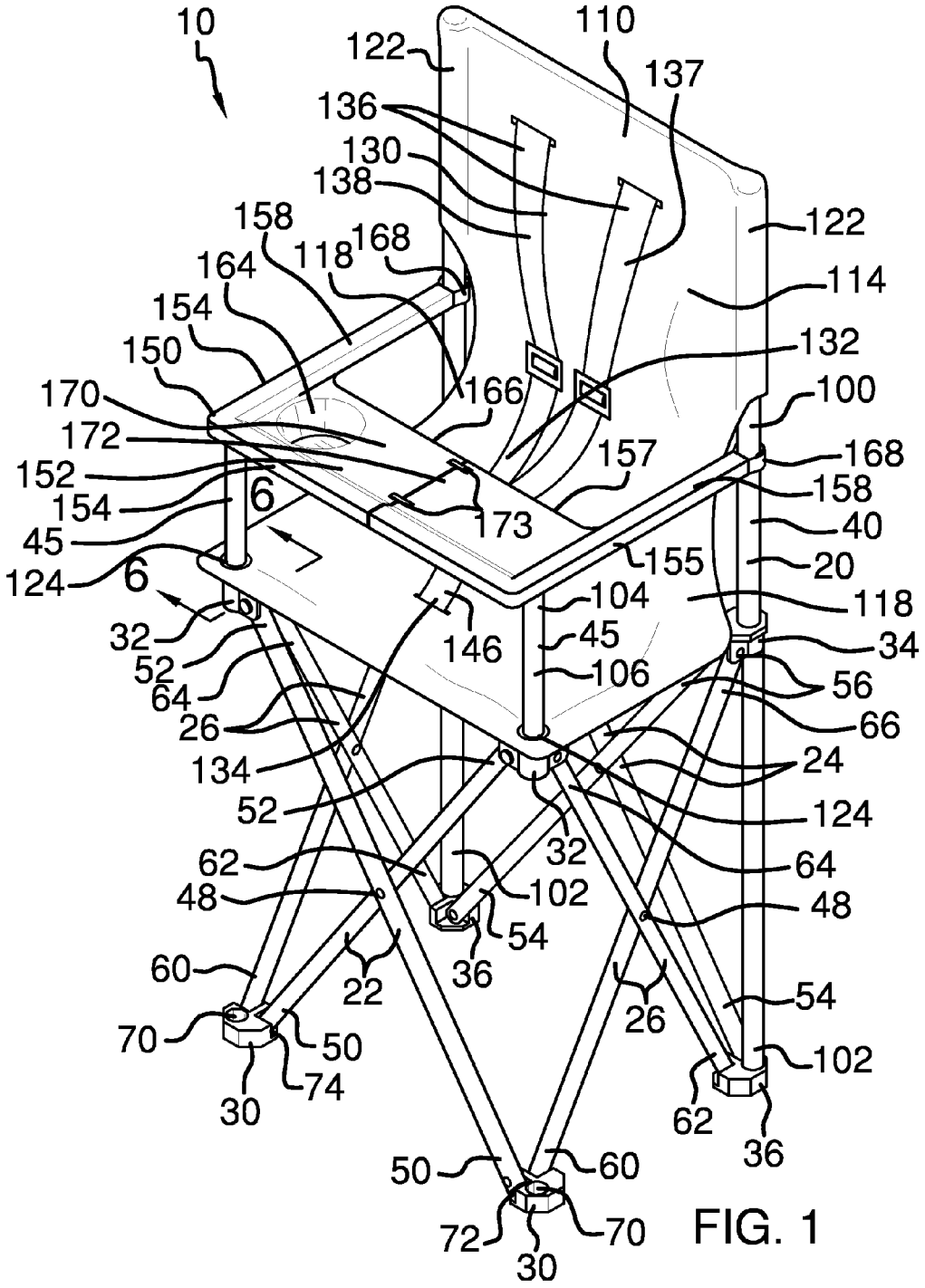
FIG. 1 is an isometric view.
Figure 2:
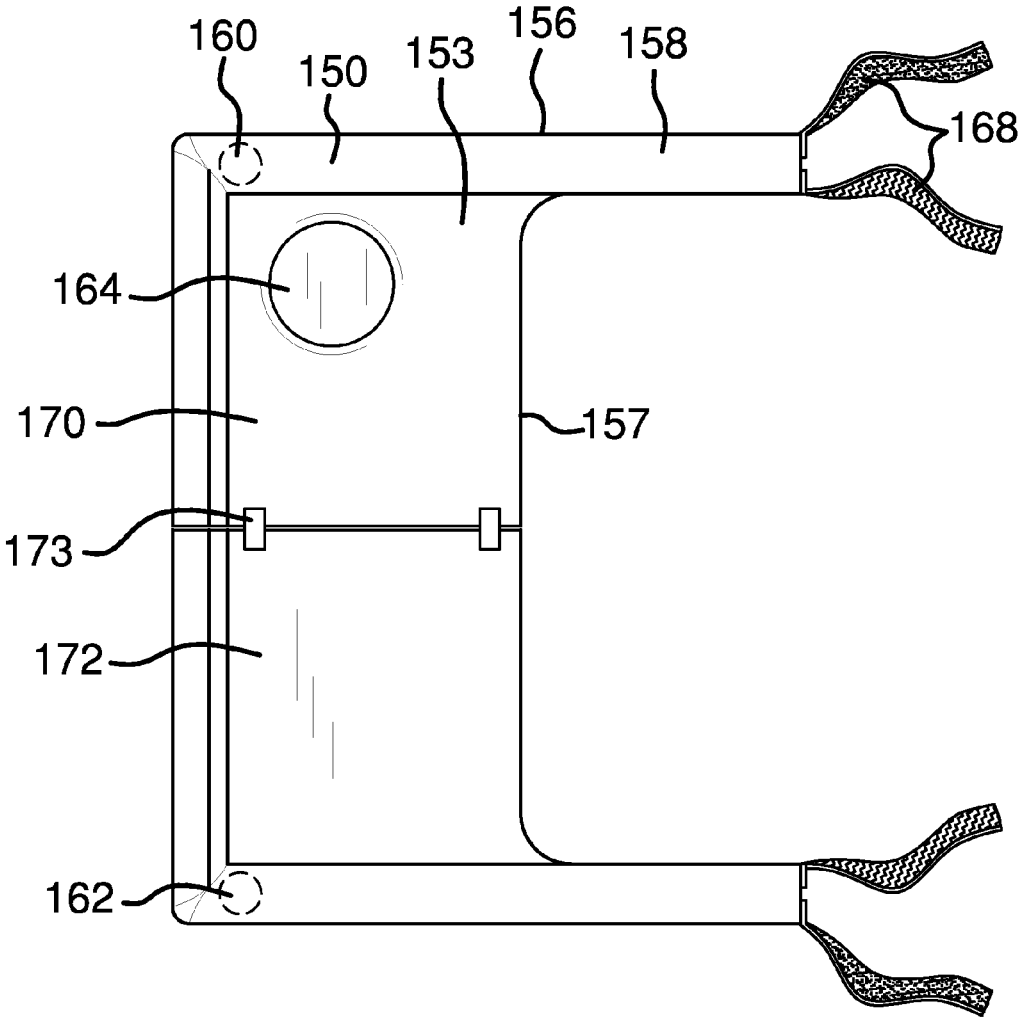
FIG. 2 is a top view of the tray.
Figure 3:
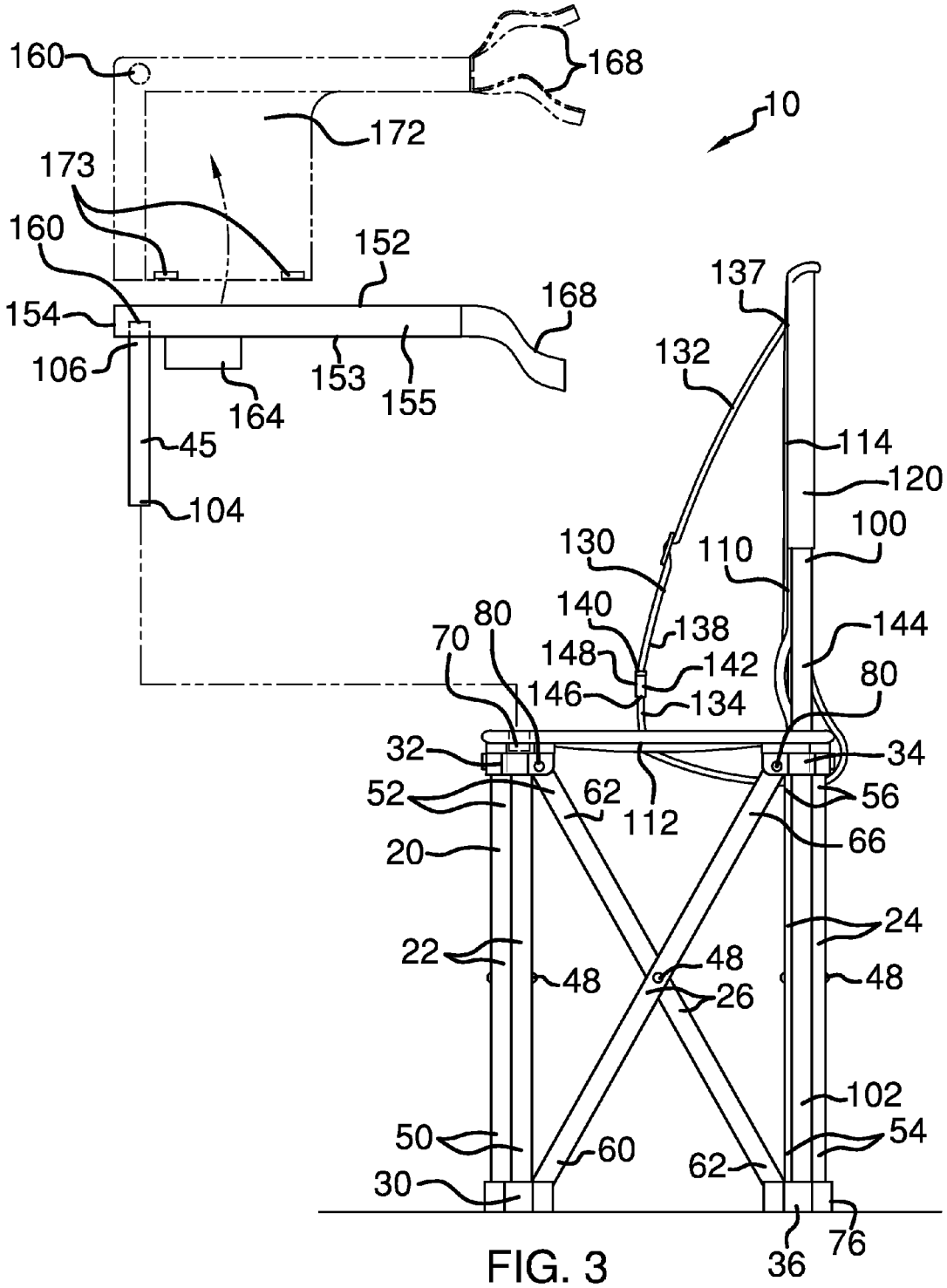
FIG. 3 is a side elevation view.
Figure 4:
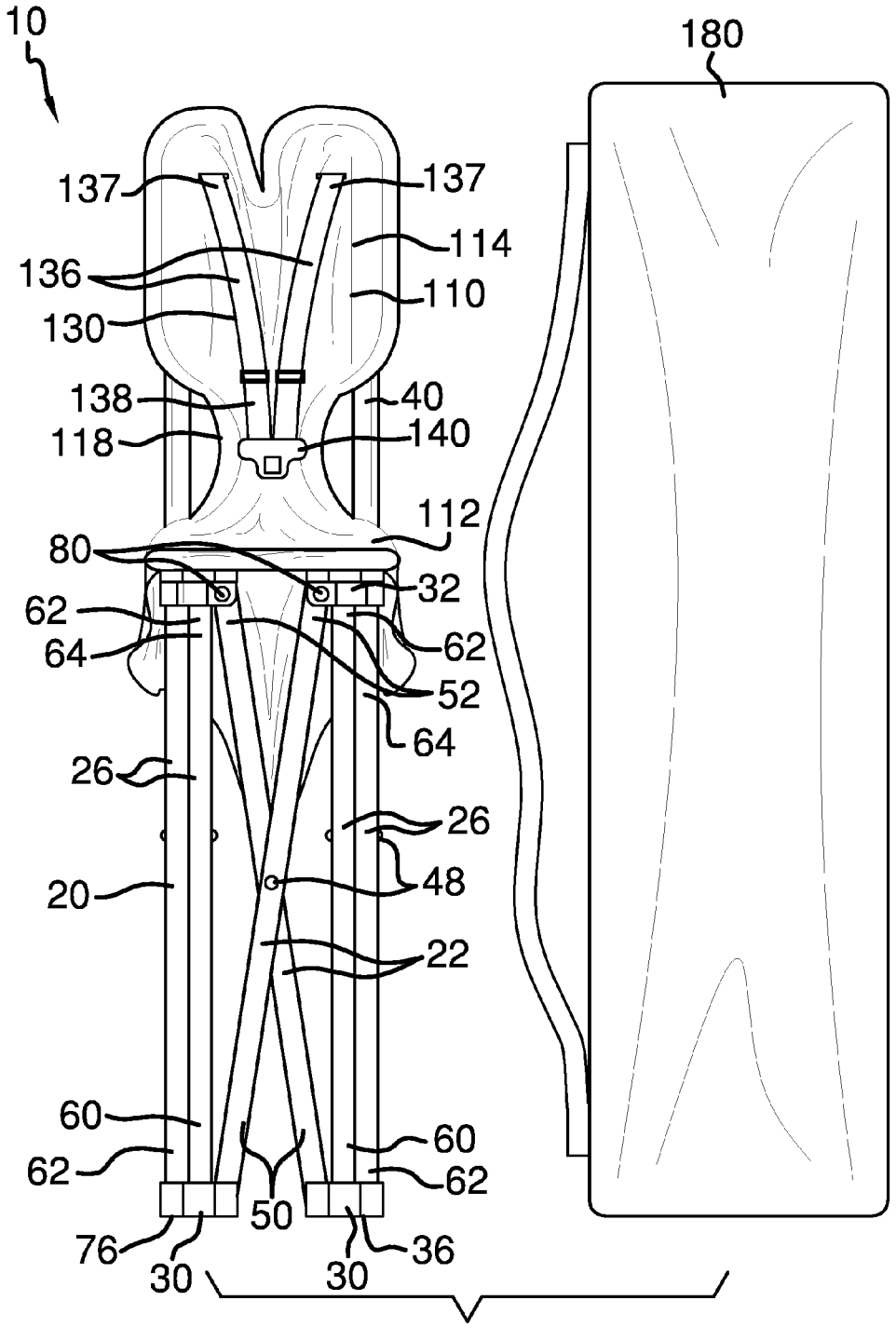
FIG. 4 is a front view in a collapsed position.
Figure 5:
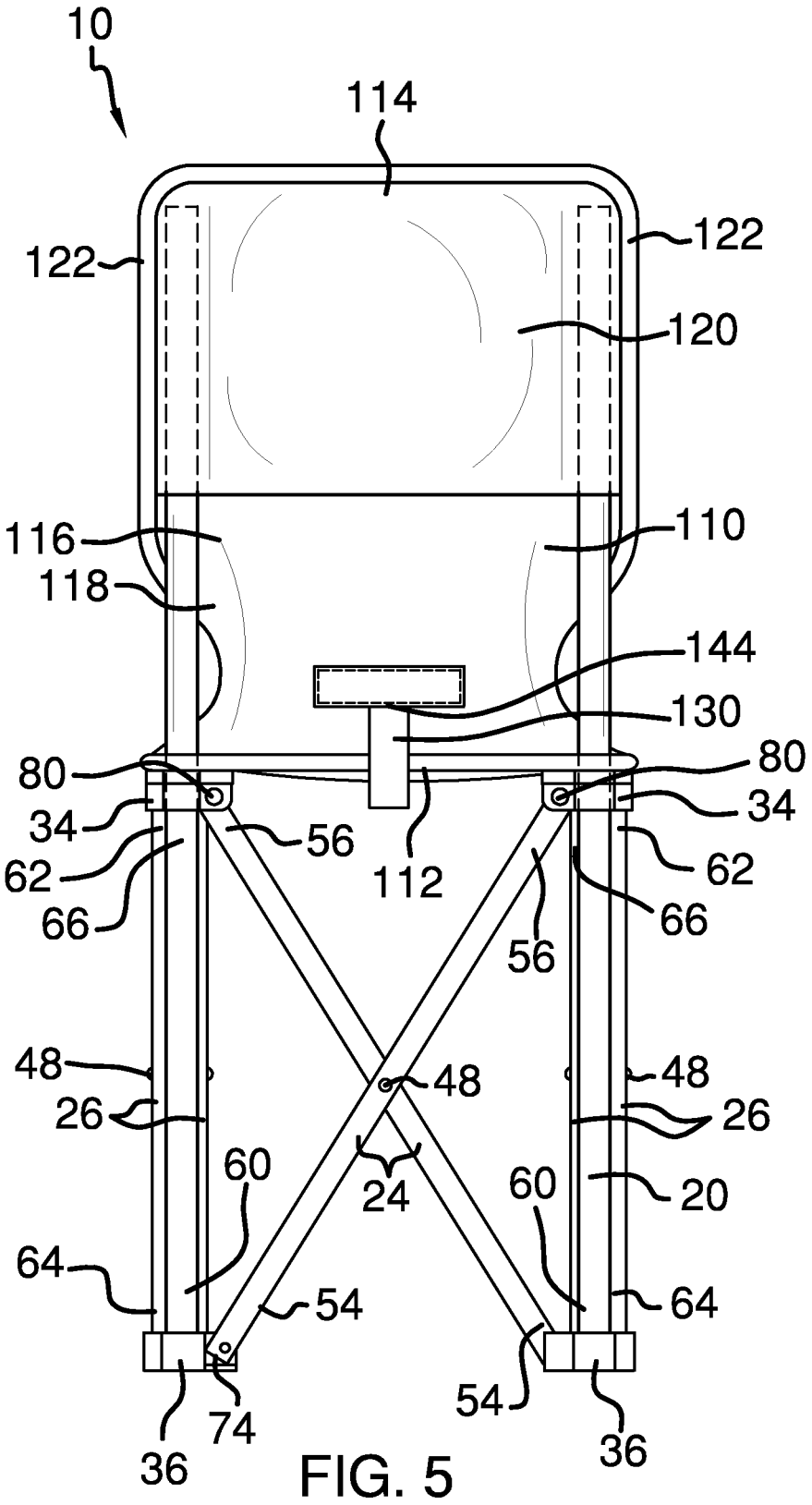
FIG. 5 is a rear elevation.
Figure 6:
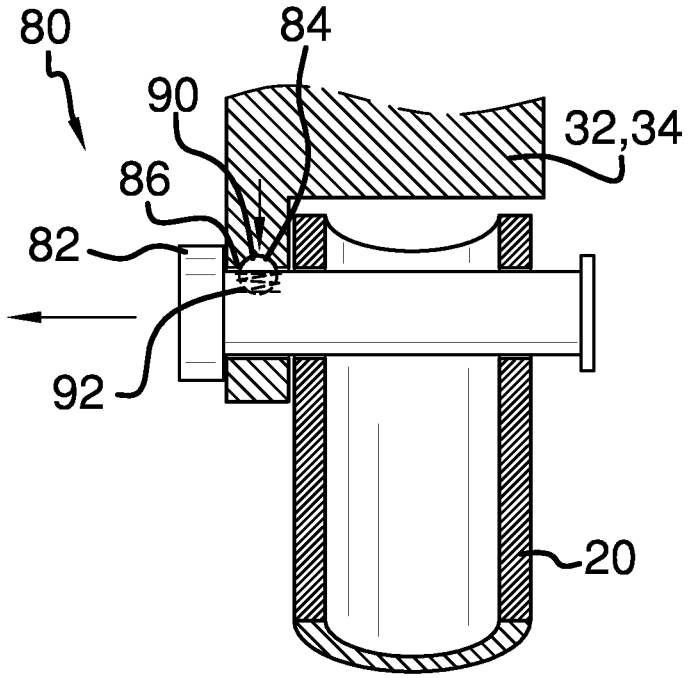
FIG. 6 is a cross-section taken along line 6-6 of FIG. 1.

With reference now to the drawings, and in particular FIGS. 1 through 6 thereof, an example of the instant collapsible high chair with locking legs employing the principles and concepts of the present collapsible high chair with locking legs and generally designated by the reference number 10 will be described.

Referring to FIGS. 1 through 6 the present collapsible high chair with locking legs 10 is illustrated. The collapsible high chair with locking legs 10 includes a collapsible frame 20 which includes a pair of front crossed legs 22, a pair of back crossed legs 24, two pairs of side crossed legs 26, a pair of lower front pads 30, a pair of upper front pads 32, a pair of upper back pads 34, a pair of lower back pads 36, a pair of vertical rear legs 40, and a pair of vertical tray supports 45.

Each one of the pair of the front crossed legs 22, the back crossed legs 24, and the side crossed legs 26 are pivotally conjoined at a central pivot point 48 between the crossed legs of the respective pair in a configuration forming an X. Each front crossed leg 22 has a lower end 50 and an upper end 52. Each back crossed leg 24 has a bottom end 54 and a top end 56. Each side crossed leg 26 in a pair of the side crossed legs has a lower front end 60, a lower back end 62, an upper front end 64, and an upper back end 66.

Each of the lower front pads 30, the upper front pads 32, the upper back pads 34, and the lower back pads 36 has a hole 70 extending transversely therethrough, a first slot 72, and a second slot 74. Each of the first 72 and second slots 74 is configured to receive and engage the respective legs.

The lower end 50 of one of the front crossed legs 22 and the lower front end 60 of one of the side crossed legs 26 are pivotally conjoined to one of each of the lower front pads 30. The bottom end 54 of one of the back crossed legs 24 and the lower back end 62 of one of the side crossed legs 26 are pivotally conjoined to one of each of the lower back pads 36. The upper end 52 of one of the front crossed legs 22 and the upper front end 64 of one of the side crossed legs 26 are pivotally conjoined to one of each of the upper front pads 32. The top end 56 of one of the back crossed legs 24 and the upper back end 66 of one of the side crossed legs 26 are pivotally conjoined to one of each of the upper back pads 34.

Each of the lower front pads 30 and the lower back pads 36 has a flat bottom wall 76. The flat bottom walls 76 are configured to support the frame on a ground surface.

Each of the upper front pads 32 and the upper back pads 34 include a locking mechanism 80. Each locking mechanism 80 has a ball locking pin 82 and an indentation 84 in a bottom side 86 of the upper front 32 and upper back pads 34. The ball locking pin 82 has a ball 90 with a spring 92. The indentation 84 is configured to receive the ball 80 and lock the frame 20 in place while the collapsible high chair with locking legs 10 is in an extended position.

Each of vertical rear legs 40 are substantially parallel to each other, each vertical rear leg 40 has a top side 100 and a bottom side 102. The bottom side 102 of the each of the vertical rear legs 40 engage the hole 70 of a respective one of each the lower back pads 36. The vertical rear legs 40 slidably engage through the hole 70 of a respective one of the upper back pads 36. Each of the vertical tray supports 45 has a lowermost end 104 and an uppermost end 106. The lowermost end 104 is removably disposed within the hole 70 of the respective one of each of the upper front pads 32.

A flexible seat 110 is attached to the frame 20. The flexible seat 110 has a seat portion 112, a back rest portion 114, and a junction portion 116 disposed between the seat portion 112 and the back rest portion 114. The junction portion 116 has a pair of concave side walls 118. A pocket 120 is disposed within the back rest portion 114. The pocket has a pair of outer sides 122. The pocket 114 is configured to receive the top side 100 of the vertical legs 40 therein proximal to a respective one of the outer sides 122. A pair of grommets 124 is disposed in the seat portion 122 in alignment with the uppermost end 106 of the vertical tray supports 45. Each grommet 124 is configured to slidingly engage one of respective the vertical tray supports 45.

A restraint harness 130 is disposed on the flexible seat 110. The restraint harness 130 includes a shoulder restraint portion 132 and a leg restraint portion 134. The shoulder restraint portion 132 has two shoulder belts 136. Each shoulder belt has a first belt end 137 and a second belt end 138. The first belt ends 137 are attached to the back rest portion 114 of the seat 110. The second belt ends 138 are attached to a male end 140 of a belt buckle 142. The leg restraint portion 134 has a third belt end 144 and a fourth belt end 146. The third belt end 144 is attached to the seat portion 112 of the seat 110. The fourth belt end 146 is attached to a female end 148 of the belt buckle 142. The female end 148 of the belt buckle 142 operationally engages the male end 140 of the belt buckle 142. The engagement of the female 148 and male 140 ends of the belt buckle 142 is configured to removably lock the shoulder restraint portion 132 to the leg restraint portion 134.

A U-shaped tray 150 removably attaches to the frame 20. The tray 150 has a top surface 152, a bottom surface 153, a front surface 154, a left side 155, a right side 156, a back side 157, and an arm 158 extending from each of the left 155 and right side 156. The bottom surface 153 has a left 160 and a right hole 162 configured to receive the vertical tray supports 145. The top surface 152 has a cylindrical cavity 164. The cylindrical cavity 164 is configured to receive a cup. Each of the right and left sides 155, 156 have a hook and loop fastener strap 168. The hook and loop fastener straps 168 are configured to attach to the vertical back legs 40 of the frame 20. The tray 150 is foldable. The tray 150 includes a right half portion 170, a left half portion 172, and at least one hinge 173 disposed between the right half portion 170 and the left half portion 172. The tray 150 is configured to fold in half upon detachment of the tray 150 from the frame 20.

The collapsible high chair with locking legs 10 includes a storage bag 180 configured to receive the collapsible chair with locking legs 10.

What is claimed is:

1. A collapsible high chair with locking legs comprising:

a collapsible frame comprising:

a pair of front crossed legs, each front crossed leg having a lower end and an upper end;

a pair of back crossed legs, each back crossed leg having a bottom end and a top end;

two pairs of side crossed legs, each side crossed leg in a pair of the side crossed legs having a lower front end, a lower back end, an upper front end, and an upper back end;

wherein each one of the pair of the front crossed legs, the back crossed legs, and the side crossed legs are pivotally conjoined at a central pivot point between the crossed legs of the respective pair in a configuration forming an X;

a pair of lower front pads, wherein the lower end of one of the front crossed legs and the lower front end of one of the side crossed legs are pivotally conjoined to one of each of the lower front pads;

a pair of upper front pads;

a pair of upper back pads;

a pair of lower back pads, wherein the bottom end of one of the back crossed legs and the lower back end of one of the side crossed legs are pivotally conjoined to one of each of the lower back pads;

wherein the upper end of one of the front crossed legs and the upper front end of one of the side crossed legs are pivotally conjoined to one of each of the upper front pads;

wherein the top end of one of the back crossed legs and the upper back end of one of the side crossed legs are pivotally conjoined to one of each of the upper back pads;

a pair of vertical rear legs substantially parallel to each other, each vertical rear leg having a top side and a bottom side, the bottom side of the each of the vertical rear legs slidingly engaging a hole in through a respective one of each the lower back pads, the vertical rear legs further slidably engaging a respective one of the upper back pads;

wherein each of the lower front pads, the lower back pads, the upper front pads, and the lower front pads has a hole extending transversely therethrough, a first slot, and a second slot, each of the first and second slots being configured to receive and engage the respective legs;

a pair of vertical tray supports, each of the vertical tray supports having a lowermost end and an uppermost end, the lowermost end being removably disposed within a respective one of each of the upper front pads;

a flexible seat attached to the frame, the flexible seat having a seat portion, a back rest portion, and a junction portion disposed between the seat portion and the back rest portion, the junction portion having a pair of concave side walls;

a pocket disposed within the back rest portion, the pocket having a pair of outer sides, the pocket being configured to receive an upper portion of the vertical posts therein proximal to a respective one of the outer sides;

a pair of grommets disposed in the seat portion in alignment with the uppermost end of the vertical tray supports, each grommet being configured to slidingly engage one of respective the vertical tray supports;

a restraint harness comprising a shoulder restraint portion and a leg restraint portion, wherein the shoulder restraint portion has two shoulder belts, each shoulder belt having a first belt end and a second belt end, the first belt ends attached to the back rest portion of the flexible seat, the second belt ends attached to a male end of a belt buckle;

wherein the leg restraint portion has a third belt end and a fourth belt end, the third belt end attached to the seat portion of the seat, the fourth belt end attached to a female end of the belt buckle, the female end of the belt buckle operationally engaging the male end of the belt buckle, wherein the engagement of the female and male ends of the belt buckle are configured to removably lock the shoulder restraint portion to the leg restraint portion;

a U-shaped tray removably attachable to the frame, the tray having a top surface, a bottom surface, a front surface, a left side, a right side, a back side, and an arm extending from each of the left and right side, the bottom surface having a left and a right hole configured to receive the vertical tray supports;

wherein the top surface has a cylindrical cavity, the cylindrical cavity configured to receive a cup;

wherein each of the right and left sides each has a hook and loop fastener strap, wherein the hook and loop fastener straps are configured to attach to the vertical back legs of the frame; and wherein each of the lower front pads and the lower back pads has a flat bottom wall, wherein the flat bottom walls are configured to support the frame and the seat on a ground surface.

2. The collapsible high chair with locking legs of claim 1 wherein the tray is foldable, the tray comprising a right half portion, a left half portion, and at least one hinge disposed between the right half portion and the left half portion, the tray configured to fold in half upon detachment of the tray from the frame.

3. The collapsible high chair with locking legs of claim 2 wherein each of the upper front pads and the upper back pads comprise a locking mechanism, each locking mechanism comprising:

a ball locking pin and an indentation in a bottom side of the upper front and upper back pads;

the ball locking pin having a ball with a spring;

the indentation configured to receive the ball and lock the legs in place while the collapsible high chair with locking legs is in an extended position.

4. The collapsible high chair with locking legs of claim 3 further comprising a storage bag configured to receive the collapsible chair with locking legs.

* * * * *